US006123510A

United States Patent [19]

Greer et al.

[11] Patent Number: 6,123,510

[45] Date of Patent: Sep. 26, 2000

[54] METHOD FOR CONTROLLING FLUID FLOW THROUGH A COMPRESSED FLUID SYSTEM

[75] Inventors: Mark R. Greer, Charlotte; James D. Mehaffey, Mooresville; Darrell F. Murray, Huntersville, all of N.C.

[73] Assignee: Ingersoll-Rand Company, Woodcliff Lake, N.J.

[21] Appl. No.: 09/016,590

[22] Filed: Jan. 30, 1998

[51] Int. Cl.[7] ..... F04B 49/00

[52] U.S. Cl. ..... 417/53; 417/295; 417/298; 417/300

[58] Field of Search ..... 417/53, 295, 298, 417/300

[56] References Cited

U.S. PATENT DOCUMENTS

| | | | |
|---|---|---|---|
| 2,440,981 | 5/1948 | Smith . | |
| 3,207,424 | 9/1965 | Crooks . | |
| 3,441,200 | 4/1969 | Huesgen | 417/300 |
| 3,860,363 | 1/1975 | Silvern et al. . | |
| 4,080,110 | 3/1978 | Szymaszek . | |
| 4,089,623 | 5/1978 | Hofmann, Jr. . | |
| 4,968,218 | 11/1990 | Koivula et al. . | |
| 4,976,588 | 12/1990 | Heckel | 417/53 |
| 5,352,098 | 10/1994 | Hood . | |
| 5,456,582 | 10/1995 | Firnhaber et al. . | |

FOREIGN PATENT DOCUMENTS

| | | | |
|---|---|---|---|
| 56-135781 | 10/1981 | Japan | 417/300 |

*Primary Examiner*—Charles G. Freay
*Assistant Examiner*—Cheryl J. Tyler

[57] ABSTRACT

A method for controlling the supply flow through a compressed fluid system having a fluid compressor with a inlet valve, and a host system in signal receiving relation with a supply flow sensor and in signal transmitting relation with a compressor controller. The method includes the following steps: sensing the actual compressed fluid supply flow, sending a first signal representing the actual compressed fluid supply flow from the flow sensor to the host system, sending a second signal, with a current corresponding to the required predetermined required inlet vacuum, from the host system to the compressor controller, sensing the actual vacuum at the fluid compressor inlet, and comparing the actual vacuum at the fluid compressor inlet to a predetermined target vacuum required to produce the desired supply flow through the compressed fluid system, and if the predetermined target vacuum is greater than the actual vacuum, performing the additional step of closing the inlet valve until the actual vacuum is substantially equal to the predetermined target vacuum and if the predetermined target vacuum is less than the actual vacuum, performing the additional step of opening the inlet valve until the actual vacuum is substantially equal to the predetermined target vacuum.

13 Claims, 4 Drawing Sheets

METHOD FOR CONTROLLING FLUID FLOW THROUGH A COMPRESSED FLUID SYSTEM

BACKGROUND OF THE INVENTION

The invention relates to a method for controlling fluid flow through a compressed fluid system, and more particularly the invention relates to a method for controlling fluid flow through a compressed fluid system by measuring the actual vacuum at the compressor inlet valve, comparing the actual vacuum to a predetermined vacuum required to produce the required fluid flow, and then opening or closing the compressor inlet valve to achieve the required predetermined inlet vacuum.

Any compressed fluid system used to supply compressed fluid to actuate a pneumatically powered machine, tool or other device must provide the compressed fluid to the pneumatically actuated object of interest at the requisite pressure. Therefore, during operation of such a system, it is necessary to continuously monitor the actual pressure of the compressed fluid that is being supplied by the compressed fluid system. Typically, in such compressed fluid systems, a pressure sensor or other suitable device is connected to the flow line and measures the actual pressure of the compressed fluid being delivered to the pneumatically actuated object of interest.

If the actual pressure of the supplied compressed fluid is less than the predetermined required supply fluid pressure, the compressor inlet valve is opened and the compressor is loaded, thereby increasing the supply pressure of the compressed fluid. The compressor remains loaded until the supply pressure reaches the predetermined required pressure. If the actual supply pressure is greater than the predetermined required compressed fluid supply pressure, the compressor inlet valve is closed and the compressor is unloaded thereby lowering the compressed fluid supply pressure. The inlet valve is closed until the compressed fluid supply pressure lowers to the predetermined required pressure value.

In conventional compressed fluid systems, compressed fluid supply pressure is measured, compared to the required supply fluid pressure and the compressor is simply loaded or unloaded to attain the requisite supply pressure. Thus conventional compressed fluid systems attempt to supply compressed fluid at a particular pressure by measuring the supply pressure and effecting the position of the inlet valve as required. Conventional compressed fluid systems do not attempt to attain a specific compressor flow.

Thus conventional compressed fluid systems, achieve the requisite supply pressure without considering the flow and this is an acceptable method for maintaining the requisite supply line pressure for most pneumatically actuated applications since, in most applications, maintaining a certain fluid pressure in a compressed fluid system produces the required compressor flow to match a demand. However, this conventional method does not ensure that the requisite flow will be supplied to pneumatically actuated processes that are dependant on the fluid flow. In a system that is flow dependent, where it is critical to the process to maintain the requisite flow, it is necessary to develop a method for matching flow to demand.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for controlling flow through a compressor, the method comprising the steps of sensing the actual vacuum at the fluid compressor inlet; and comparing the actual vacuum at the fluid compressor inlet to a predetermined target vacuum required to produce the desired flow through the compressed fluid system, and if the predetermined target vacuum is greater than the actual vacuum, performing the additional step of closing the inlet valve until the actual vacuum is equal to or substantially equal to the predetermined target vacuum; and if the predetermined target vacuum is less than the actual vacuum, performing the additional step of opening the inlet valve until the actual vacuum is equal to or substantially equal to the predetermined target vacuum.

The foregoing and other aspects will become apparent from the following detailed description of the invention when considered in conjunction with the accompanying drawing figures.

DESCRIPTION OF THE DRAWING FIGURE

DESCRIPTION OF THE PREFERRED EMBODIMENT

Figure 1:
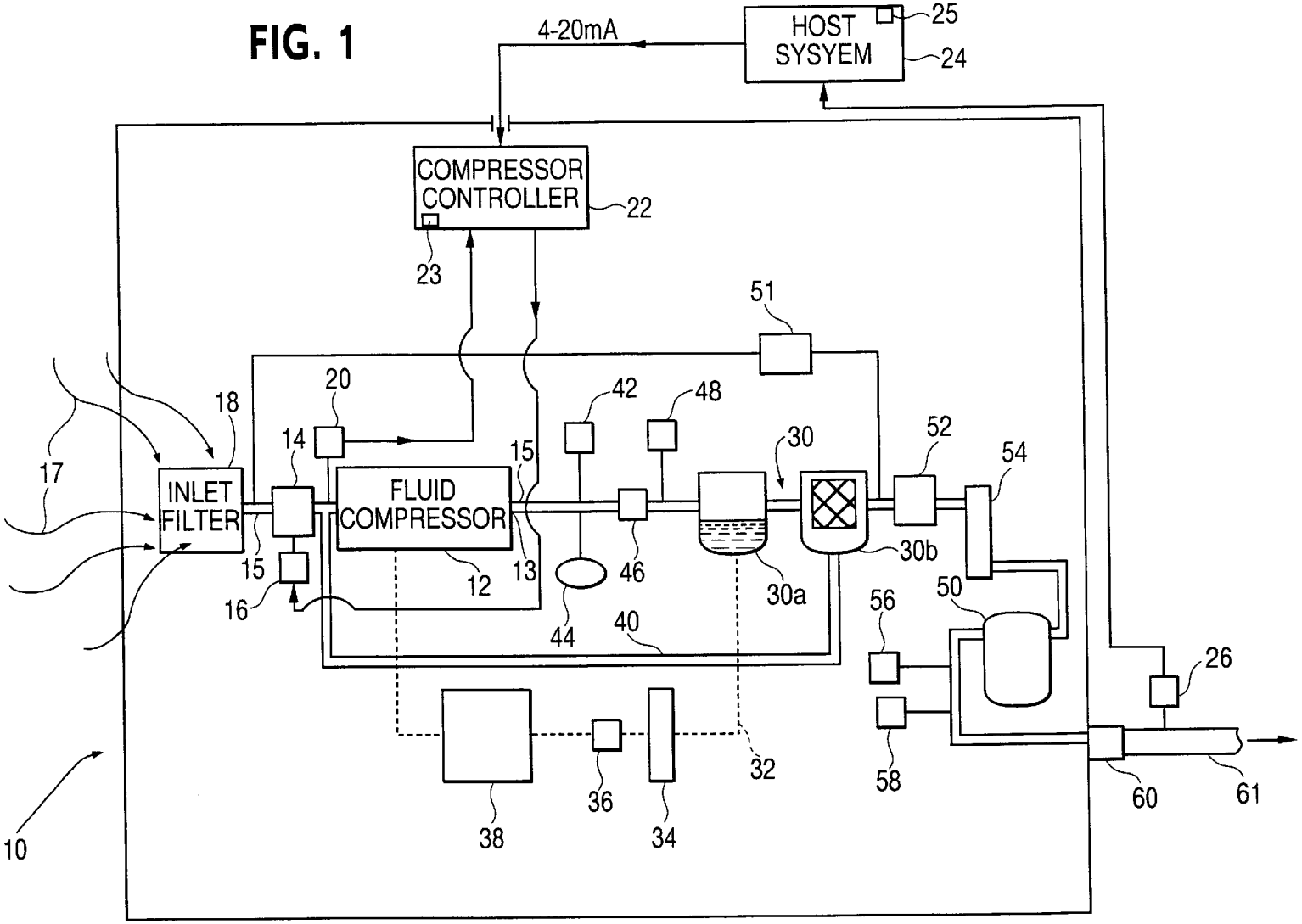
FIG. 1 is a schematic representation of a compressed fluid system that utilizes the method of the present invention.

Turning now to the drawing Figure wherein like parts are referred to by the same number throughout the several views, and particularly FIG. 1, fluid compression system 10 includes a compressor generally identified at 12. The compressor is a conventional rotary screw compressor comprised of an air end with male and female interengaging rotors, and is driven by a prime mover such as an electric motor (both not shown). The rotary screw compressor and prime mover are conventional components well known to one skilled in the art and therefore no additional description of these components of system 10 is required.

Compressor inlet valve 14 which may be a conventional butterfly type inlet valve, controls the volume of ambient fluid that is supplied to the fluid compressor 12 and is flow connected to compressed fluid system supply line 15. Valve positioning means 16 is operably connected to inlet valve 14 and serves to open and close the inlet valve as required during operation of the compressor 12. The valve positioning means may be any means suitable to open and close the inlet valve, such as stepper motor, for example. Ambient fluid such as air flows into the inlet valve in the direction of arrows 17 after passing through inlet filter 18, is compressed by compressor 12 and is discharged through compressor discharge 13.

Inlet valve vacuum sensor 20 is made integral with the segment of supply line 15 that flow connects the inlet valve 14 and the inlet of compressor 12, and serves to measure the vacuum at the compressor inlet. As shown in FIG. 1, the vacuum sensor is in signal transmitting relation with compressor controller 22, and the compressor controller is in signal transmitting relation with valve positioning means 16. The compressor controller includes a memory 23.

The compressor controller may be any suitable electronic based controller however for purposes of describing the preferred embodiment of the invention, controller 22 is the controller described in U.S. Pat. No. 5,054,995 the description of which is incorporated herein by specific reference.

Compressor controller 22 is in signal receiving relation with host system 24. The host system 24 may be any suitable conventional programmable logic controller or portable computer that can transmit a 4–20 milliAmp (mA) signal to the compressor controller 22 indicating if the inlet valve needs to be opened, closed or if the position of the valve should not be effected. Predetermined system parameters such as the required supply fluid flow are stored on host system memory 25. As will be described below, the parameters and data stored on host system memory is utilized to determine if the required supply flow is being maintained.

The host system is in signal receiving relation with conventional supply fluid pressure sensor 26 which is connected to system supply line 61 and obtains the actual flow of compressed fluid through system supply line 61. The operation of and communication between the host system 24 and compressor controller 22 will be described in greater detail below.

For purposes of clarity, as the description proceeds, the terms "supply flow", "capacity", and "compressor flow" shall mean the flow of compressed fluid through the compressed fluid system supply line 15.

The signal that is transmitted from the host system 24 to the compressor controller 22 may be an analog or serial signal however for purposes of describing the preferred embodiment of the invention, the signal will be of the type that may be transmitted via a analog connection between the host 24 and controller 22.

Separator 30 is flow connected in flow line 15 downstream from compressor discharge 13, and the separator which is of conventional design, serves to separate and collect the lubricant and other liquid that is discharged with the compressed fluid. Separator element 30*a* collects lubricant that is scavenged back to compressor 12 and is reinjected into the compression module of the compressor. The coolant collected in the sump portion of separator tank 30*a* is flowed through conventional lubricant supply line 32, lubricant cooler 34, thermostatic control valve 36, and coolant filter 38, before it is reinjected to compressor. Oil or other lubricant is scavenged in a conventional manner from separator tank 30*b* through scavenge line 40 back to other components of compressor 12.

Also flow connected to supply line 15 are fluid temperature sensor 42 high air temperature switch 44, discharge check valve 46, fluid pressure transducer 48, blowdown solenoid 51, and minimum pressure check valve 52. Although the connection is not shown, the fluid pressure transducer 48 may be electrically or otherwise connected to controller 22 to supply pressure signals to the controller which may be analyzed by the controller to affect compressor performance.

Additional liquid such as water that is mixed with the compressed fluid is captured in a moisture separator 50 that is downstream from separator 30.

The warm supply fluid is cooled by aftercooler 54 that is upstream from separator 50. Fluid temperature sensor 56 and fluid pressure transducer 58 sense temperature and pressure of the fluid that is supplied to an object of interest after it is flowed out of system 10 through discharge port 60.

All of the sensors, transducers, separators, filters employed in system 10 are of conventional design well known to one skilled in the art, and therefore do not require further description.

Figure 2:
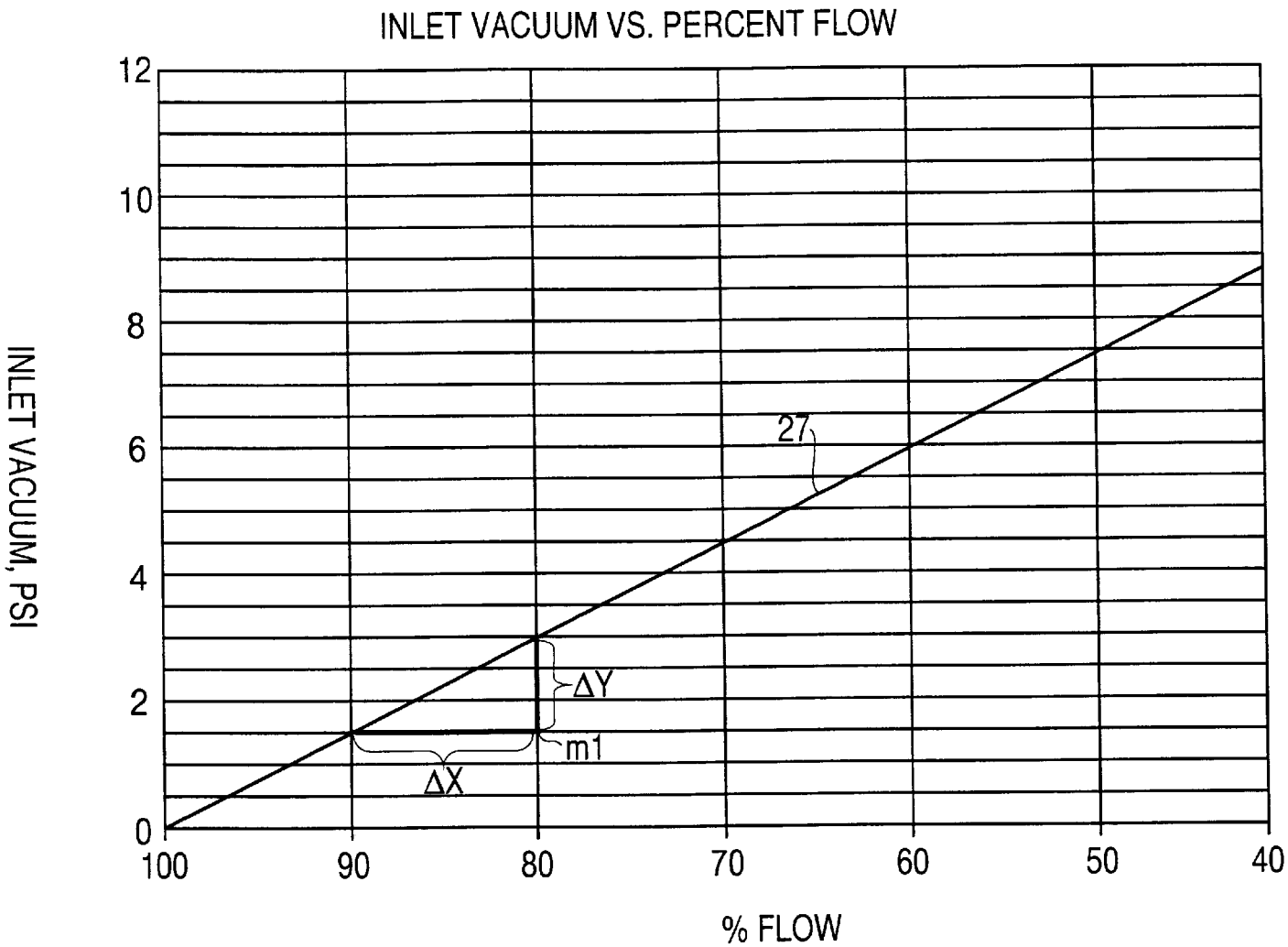
FIG. 2 is a graph of inlet vacuum versus supply flow for the compressed fluid system of FIG. 1.
Figure 3:
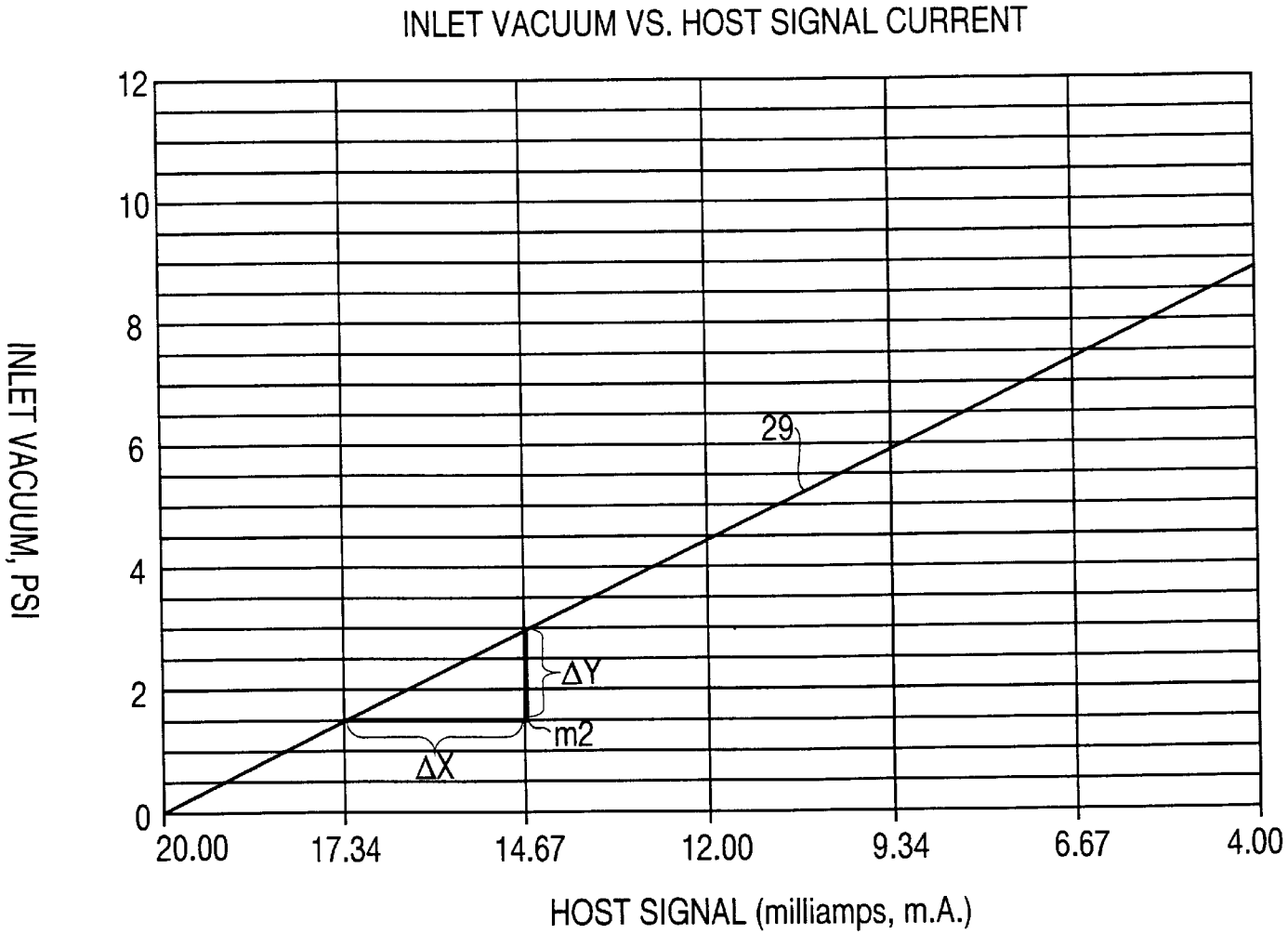
FIG. 3 is a graph of inlet vacuum versus host signal current for the compressed fluid system of FIG. 1.

FIGS. 2 and 3 respectively, graphically illustrate the relationship between inlet vacuum and percent supply flow through the inlet and host signal current. The information and relationships shown graphically in both Figures is stored in compressor controller memory 23 and host memory 25 and is accessed during operation of system 10 to determine what signals should be sent by the host to the controller and whether the inlet should be opened or closed to achieve the required vacuum and thereby ensure the requisite flow of supply fluid is maintained.

In FIG. 2, inlet vacuum and flow are shown to be directly proportional as indicated by curve 27 having slope, m1, defined as $\Delta y/\Delta x$. Curve 27 is substantially linear.

FIG. 3 graphically shows the direct proportionality between inlet vacuum and host signal current as illustrated by curve 29 with slope m2. Curve 29 is substantially linear. The slopes m1 and m2 of the curves 27 and 29 are equal. Since the slopes are the same for a given inlet vacuum, the host and controller can determine the required vacuum to achieve the required flow. For example, at a point on line 29, with (x,y) coordinates (20.00,0) the corresponding point on line 27, would be (100,0). Thus at an inlet vacuum of zero, the signal would be 20 mA and the inlet would be fully loaded. Additionally, on curve 29, for point (4.00, 8.8), the corresponding point on curve 27 would be (40, 8.8). For a vacuum of 8.8, the host signal would be 4 mA and the inlet would be 40% of full load. Thus for a given vacuum, the host signal will correspond to a supply flow. These relationships which are shown graphically in FIGS. 2 and 3 are stored in memories 23 and 25.

The method of the present invention will now be described.

After the compressed fluid system 10 has been started and the inlet valve 14 is opened by positioning means 16 to the position required to produce the required inlet vacuum and thereby provide the required supply flow, the supply flow through the compressor is sensed by flow sensing means 26. Signals representing the actual supply flow sensed supply flow are sent to the host system 24 by the flow sensing means 26. The actual supply flow is compared to the required supply flow value stored in memory 25. The required supply flow is entered in the host system memory by the compressor operator before or during operation of system 10.

If the actual supply flow is not at the predetermined required level, the host system sends a signal corresponding to the required supply flow to the compressor controller 22. The required signal is determined by the information illustrated in FIGS. 2 and 3 stored in host memory 25.

The host signal has a current between 4 mA and 20 mA. The host system signal corresponds to the required supply flow through the system 10. If the system requires maximum flow, so that the compressor would be fully loaded, a signal of 20 mA would be sent to the compressor controller. Conversely, if minimum supply flow through the compressed fluid system is required, forty percent of full flow for example, a 4 mA signal is sent to the compressor controller. Signals between 4–20 mA would be sent by the host to the controller 22 if supply flow between the maximum and minimum flow is required.

The relationship illustrated in the graph of FIG. 3, is stored in the compressor controller memory. When the compressor controller 22 receives the 4–20 mA signal from the host system, the controller calculates the vacuum required to produce the required supply flow as represented by the signal. For example, using FIG. 3 to illustrate such a calculation, if the host signal is 14.67 mA, the controller 22 would calculate a required inlet vacuum of 3 psi. This calculated value becomes the target inlet vacuum.

Figure 4:
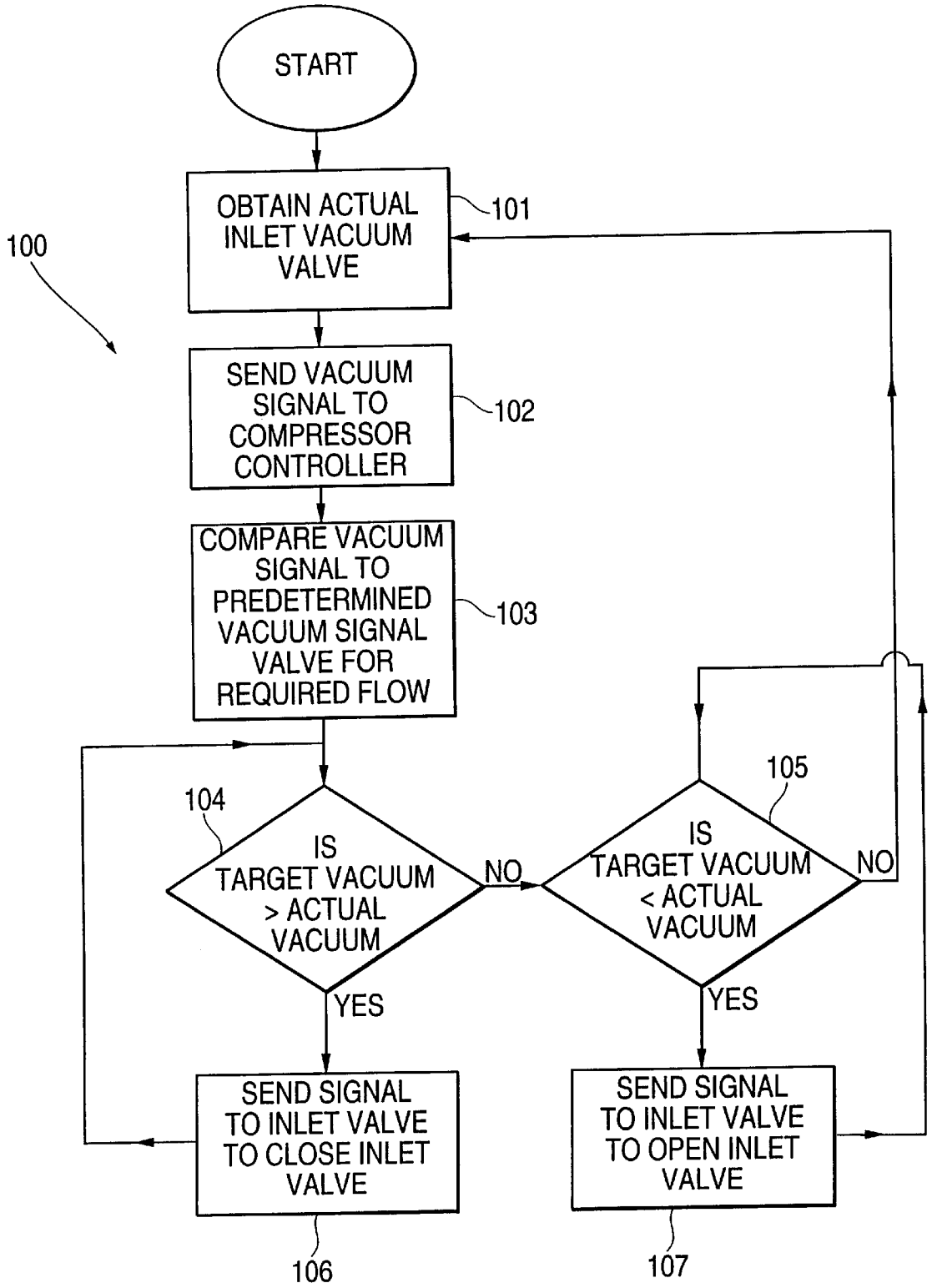
FIG. 4 is a block diagram representation of the logic used by the compressor controller to determine if the compressor inlet vacuum is at the required value to achieve the desired supply flow.

Once the target inlet vacuum is calculated, signals representing the actual inlet vacuum are sent by vacuum sensor 20 to the compressor controller, as indicated in step 102 in FIG. 4. The actual inlet vacuum is sensed on regular time intervals in step 101 of logic diagram 100.

In step 103, the actual sensed inlet vacuum is compared to the calculated predetermined target inlet vacuum required to produce the requisite supply flow.

In decision step 104, if the target inlet vacuum is greater than the actual inlet vacuum, the compressor controller sends a signal to the inlet valve positioning means, in step 106, to close the valve. Decision step 104 is repeated until the target vacuum is substantially at the required value. Then assuming the answer to decision step 105 is "no", the routine returns to step 101.

If the answer to decision step 104 is "no" the controller proceeds to step 105 and determines if the target inlet vacuum is less than the actual inlet vacuum. If the answer to decision step 105 is "yes", the compressor controller sends a signal to valve positioning means 16, in step 107, to thereby open the inlet valve the required amount. Decision block 105 is repeated until the target vacuum is substantially at the required value, and then the system returns to step 101.

If the answers to decision steps 104 and 105 are no, the controller proceeds back to the beginning of the routine, 100 and once a signal is received from the host system the inlet valve is repositioned to achieve the required flow. The routine is executed quite rapidly and serves to rapidly modulate the compressor to maintain the required flow in response to inlet vacuum.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. In a compressed fluid system having a fluid compressor with an inlet valve, and a host system in signal receiving relation with a supply flow sensor and in signal transmitting relation with a compressor controller, a method for controlling the supply flow through the compressed fluid system, the method comprising the following steps:

sensing the actual compressed fluid supply flow;

sending a first signal representing the actual compressed fluid supply flow from the flow sensor to the host system;

sending a second signal, with a current corresponding to the required predetermined required inlet vacuum, from the host system to the compressor controller;

sensing the actual vacuum at the fluid compressor inlet; and comparing the actual vacuum at the fluid compressor inlet to a predetermined target vacuum required to produce the desired supply flow through the compressed fluid system, and if the predetermined target vacuum is greater than the actual vacuum, performing the additional step of closing the inlet valve until the actual vacuum is substantially equal to the predetermined target vacuum; and if the predetermined target vacuum is less than the actual vacuum, performing the additional step of opening the inlet valve until the actual vacuum is substantially equal to the predetermined target vacuum.

2. The method as claimed in claim 1 wherein the second signal has a current between 4 and 20 mA.

3. The method as claimed in claim 2 wherein the 20 mA signal corresponds to a minimum inlet vacuum and the 4 mA signal corresponds to a maximum inlet vacuum.

4. The method as claimed in claim 2 wherein the second signal also corresponds to the supply flow through the compressor, and wherein the 20 mA signal corresponds to maximum supply flow through the compressor, and the 4 mA signal corresponds to minimum supply flow through the compressor.

5. The method as claimed in claim 1 wherein the fluid compressor is a rotary screw compressor.

6. In a compressed fluid system having a fluid compressor with an inlet valve, a compressor controller, a host system in signal receiving relation with a supply flow sensor and in signal transmitting relation with the compressor controller, the method comprising the following steps:

a) sensing the actual compressed fluid supply flow;

b) sending a first signal representing the actual compressed fluid supply flow from the flow sensor to the host system;

c) sending a second signal, with a current corresponding to the required predetermined required inlet vacuum, from the host system to the compressor controller;

d) calculating the required inlet vacuum required to achieve the required supply flow;

e) sensing the actual vacuum at the fluid compressor inlet; and f) comparing the actual vacuum at the fluid compressor inlet to a predetermined target vacuum required to produce the desired supply flow through the compressed fluid system, and if the predetermined target vacuum is greater than the actual vacuum, performing the additional step of closing the inlet valve until the actual vacuum is substantially equal to the predetermined target vacuum; and if the predetermined target vacuum is less than the actual vacuum, performing the additional step of opening the inlet valve until the actual vacuum is substantially equal to the predetermined target vacuum.

7. The method as claimed in claim 6 wherein the second signal has a current between 4 and 20 mA.

8. The method as claimed in claims 7 wherein the 20 mA signal corresponds to a minimum inlet vacuum and the 4 mA signal corresponds to a maximum inlet vacuum.

9. The method as claimed in claim 8 wherein the second signal also corresponds to the supply flow through the compressor, and wherein the 20 mA signal corresponds to maximum supply flow through the compressor, and the 4 mA signal corresponds to minimum supply flow through the compressor.

10. The method as claimed in claim 9 wherein the inlet vacuum is directly proportional to supply flow, and wherein the inlet vacuum is directly proportional to the host signal.

11. The method as claimed in claim 10 wherein the relationship between the inlet vacuum and supply flow is substantially linear having a first slope, and wherein the relationship between the inlet vacuum and host signal value is substantially linear having a second slope.

12. The method as claimed in claim 11 wherein the first and second slopes are equal.

13. The method as claimed in claim 6 wherein the fluid compressor is a rotary screw compressor.

* * * * *